US011773791B1

(12) United States Patent
Gwidt et al.

(10) Patent No.: US 11,773,791 B1
(45) Date of Patent: Oct. 3, 2023

(54) MULTI-PULSE FUEL INJECTION SYSTEMS AND CONTROL LOGIC FOR PORT FUEL INJECTION PULSE MONITORING IN ENGINE ASSEMBLIES

(71) Applicant: GM GLOBAL TECHNOLOGY OPERATIONS LLC, Detroit, MI (US)

(72) Inventors: J. Michael Gwidt, Brighton, MI (US); Daniel P. Himes, Detroit, MI (US); Mark D. Carr, Fenton, MI (US); Jonathan A. Law, Fenton, MI (US); Jeffrey M. Hutmacher, Fowlerville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 17/987,085

(22) Filed: Nov. 15, 2022

(51) Int. Cl.

| | |
|---|---|
| ***F02D 41/22*** | (2006.01) |
| ***F02D 41/40*** | (2006.01) |
| ***F02D 13/02*** | (2006.01) |
| ***F02D 41/30*** | (2006.01) |

(52) U.S. Cl.
CPC ..... *F02D 13/0219* (2013.01); *F02D 41/221* (2013.01); *F02D 41/3017* (2013.01); *F02D 41/402* (2013.01); *F02D 41/403* (2013.01); *F02D 41/405* (2013.01); *F02D 2041/224* (2013.01); *F02D 2200/0618* (2013.01); *F02D 2200/1015* (2013.01)

(58) Field of Classification Search
CPC .... F02D 41/402; F02D 41/403; F02D 41/405; F02D 2041/221; F02D 2041/224; F02D 2200/0618; F02D 2200/1015
USPC ..... 73/114.02, 114.45, 114.49; 123/299, 479
See application file for complete search history.

(56) References Cited

U.S. PATENT DOCUMENTS

| | | | |
|---|---|---|---|
| 6,994,072 | B2 | 2/2006 | Kuo et al. |
| 7,128,047 | B2 | 10/2006 | Kuo et al. |
| 7,367,313 | B2 | 5/2008 | Chang et al. |
| 7,689,343 | B2 | 3/2010 | Dagci et al. |
| 8,000,882 | B2 | 8/2011 | Ramappan et al. |
| 8,210,158 | B2 | 7/2012 | Kang et al. |
| 8,316,818 | B2 | 11/2012 | Ramappan et al. |
| 8,347,860 | B2 | 1/2013 | Kang et al. |
| 8,776,737 | B2 | 7/2014 | Bayer et al. |
| 9,074,551 | B2 | 7/2015 | Yun et al. |
| 9,574,537 | B2 | 2/2017 | Hayman et al. |

(Continued)

*Primary Examiner* — Erick R Solis
(74) *Attorney, Agent, or Firm* — Quinn IP Law

(57) ABSTRACT

Presented are multi-pulse fuel injection systems for monitoring engine fuel injectors for missed pulses, methods for making/using such systems, and vehicles equipped with such systems. A method of operating a fuel injection system includes an engine controller determining if the system's injectors are operating in a multi-pulse mode for injecting multiple fuel pulses per combustion cycle to an engine's cylinders and, if so, monitoring pulse signals transmitted to the injectors for injecting the multiple fuel pulses. For each combustion cycle for each injector, the controller flags a cylinder misfire if any one of the fuel pulses for that combustion cycle is missed. For each cylinder, the controller calculates a misfire ratio of a total number of cylinder misfires to a total number of combustion cycles; if one of these misfire ratios exceeds a calibrated misfire limit, the controller commands a resident subsystem to execute control operations to mitigate the misfires.

20 Claims, 2 Drawing Sheets

(56) References Cited

U.S. PATENT DOCUMENTS

| | | | | |
|---|---|---|---|---|
| 9,810,173 | B2 | 5/2017 | Hayman et al. | |
| 9,689,321 | B2 | 6/2017 | Kang et al. | |
| 9,689,339 | B2 | 6/2017 | Kang et al. | |
| 9,982,624 | B1 | 5/2018 | Jun-Mo et al. | |
| 10,167,809 | B1 | 1/2019 | Domenech-Llopis et al. | |
| 11,466,641 | B1 | 10/2022 | Gwidt | |
| 2007/0023011 | A1* | 2/2007 | Ohno | F02D 41/266 123/479 |
| 2010/0294232 | A1 | 11/2010 | Otterstrom | |
| 2012/0296553 | A1* | 11/2012 | Bagnasco | F02D 41/221 701/103 |
| 2013/0080026 | A1 | 3/2013 | Kang et al. | |
| 2020/0200115 | A1* | 6/2020 | Ahn | F02D 41/221 |
| 2021/0115872 | A1* | 4/2021 | Sarwar | F02D 41/3845 |

* cited by examiner

MULTI-PULSE FUEL INJECTION SYSTEMS AND CONTROL LOGIC FOR PORT FUEL INJECTION PULSE MONITORING IN ENGINE ASSEMBLIES

INTRODUCTION

The present disclosure relates generally to combustion-type engines. More specifically, aspects of this disclosure relate to multi-pulse fuel injection systems and control strategies for reciprocating-piston type internal combustion engine assemblies.

Current production motor vehicles, such as the modern-day automobile, are originally equipped with a powertrain that operates to propel the vehicle and power the vehicle's onboard electronics. In automotive applications, for example, the vehicle powertrain is generally typified by a prime mover that delivers driving torque through an automatic or manually shifted power transmission to the vehicle's final drive system (e.g., differential, axle shafts, corner modules, road wheels, etc.). Automobiles have historically been powered by a reciprocating-piston type internal combustion engine (ICE) assembly due to its ready availability and relatively inexpensive cost, light weight, and overall efficiency. Such engines include compression-ignited (CI) diesel engines, spark-ignited (SI) gasoline engines, two, four, and six-stroke architectures, and rotary engines, as some non-limiting examples. Hybrid-electric and full-electric vehicles, on the other hand, utilize alternative power sources to propel the vehicle and, thus, minimize or eliminate reliance on a fossil-fuel based engine for tractive power.

A typical overhead valve (OHV) internal combustion engine is constructed with an engine block that contains a succession of internal cylinder bores, each of which has a piston reciprocally movable therein. Mounted onto the engine block is a cylinder head that cooperates with each piston-and-cylinder bore pair to form a variable-volume combustion chamber. These reciprocating pistons are used to convert pressure—generated by igniting a fuel-and-air mixture inside the combustion chamber—into rotational forces to drive an engine crankshaft. The cylinder head defines intake ports through which air, provided by an intake manifold, is introduced into each combustion chamber. Exhaust ports defined in the cylinder head evacuate exhaust gases and byproducts of combustion from the discrete combustion chambers to an exhaust manifold. This exhaust manifold, in turn, collects and combines exhaust gases for metered recirculation into the intake manifold, delivery to a turbine-driven turbocharger, or evacuation from the vehicle through an exhaust system.

Four-stroke combustion engines commonly operate—as the name suggests—in four distinct stages or "strokes" to drive the engine's crankshaft. At an initial (first) stage of operation, referred to as the "intake stroke," a metered mixture of fuel and air is fed into one or more select cylinders as the piston travels rectilinearly from top-to-bottom along the length of the bore. Engine intake valves are opened such that a vacuum pressure generated by the downward-travelling piston draws air into the chamber. For direct-injection systems, a metered quantity of finely atomized fuel is introduced into the chamber via a fuel injector. During a subsequent (second) stage, referred to as the "compression stroke," the intake and exhaust valves are closed as the piston travels from bottom-to-top and concomitantly compresses the fuel-air mixture. Upon completion of the compression stroke, a following (third) stage or "power stroke" commences when a spark plug ignites the compressed fuel and air, with the resultant expansion of gases pushing the piston back to bottom dead center (BDC). During a successive stage—known as the "exhaust stroke"—the piston once again returns to top dead center (TDC) with the exhaust valves open; the travelling piston expels the spent air-fuel mixture from the combustion chamber. To complete the four strokes of a single working (Otto) cycle entails two revolutions of the crankshaft.

There are two primary types of fuel injection systems common for modern engine assemblies—port injection and direct injection. Port fuel injection (PFI) systems, also known as "manifold injection" (MI), spray fuel into the intake runners, upstream from the intake valves, where it mixes with incoming air before entering the cylinders. Direct-injection (DI) engines, on the other hand, employ dedicated fuel injectors that are mounted to the cylinder head and inject fuel directly into the cylinders. Conventional DI systems control the injectors to infuse a single pulse of pressurized fuel into the combustion chamber and, following the compression stroke, ignite the condensed fluid mixture when the piston is at TDC of the piston stroke. Fuel injection pulse modulation may be optimized to produce different combustion characteristics and, thus, improved engine performance. Some DI and PFI systems employ controller-actuated fuel injectors to deliver multiple consecutive fuel pulses per single combustion event to vary cylinder charge composition and temperature. In such multi-pulse delivery control systems, variation of the injector current profiles—and thus the fuel pulse profiles—of consecutive fuel pulses in a single combustion chamber may provide more precise control of the overall fuel delivery.

SUMMARY

Presented herein are multi-pulse fuel injection systems with attendant control logic for monitoring engine fuel injectors for missed pulses, methods for manufacturing and methods for operating such systems, and motor vehicles equipped with intelligent control systems for detecting missing fuel pulses in PFI-DI fuel systems. For example, an internal combustion engine assembly may be equipped with a hybrid PFI-DI fuel system that employs both PFI injectors and DI injectors for provisioning multi-pulse pressurized fuel injection per cylinder per cycle. An engine control module (ECM) executes a PFI monitoring algorithm to identify missing PFI injector pulses, e.g., during engine operating modes when both the PFI and DI injectors are used in the same combustion cycle. For each combustion event, the algorithm monitors the PFI injectors of the individual cylinders, tracks the ECM driver command signals output for the multiple PFI pulses, and detects if any of these pulses are not fulfilled by the PFI injectors. The algorithm may monitor all commanded pulses for all PFI injectors at all cylinders while concomitantly detecting and recording all completed and all missing PFI pulses. Each time a single or multiple pulses is missed in a given event for a cylinder, a failure is counted and stored in memory. If a ratio of total number of failures to total number of combustion events for a given cylinder exceeds a system-calibrated PFI failure limit, a diagnostic code may be set and PFI injection may be disabled for that cylinder and, if desired, for the remaining cylinders.

Attendant benefits for at least some of the disclosed concepts include multi-pulse fuel injection systems that actively monitor the individual injectors to detect missed pulses during multi-pulse engine operating modes and responsively automate ameliorative action to remediate excessive misfires. Optimized operation of multi-pulse fuel injection systems, in turn, may help to meet more stringent vehicle emission standards and fuel economy requirements. Consistent and reliable multi-pulse fuel delivery may also be utilized to produce rapid catalytic light-off and to provide a lean homogeneous fuel mixture. Other attendant benefits may include PFI monitoring algorithms that enable the freedom of any ratio between PFI to DI (e.g., hybrid fuel injection systems operating ratios of PFI to DI at or above 70:30). Disclosed fuel injection systems, control logic, and engine assemblies may also facilitate optimum combustion timing for CA50 (crankshaft angle where 50% of injected fuel has burned) with an improvement in fuel consumption.

Aspects of this disclosure are directed to engine control systems, system control logic, and memory-stored instructions for monitoring engine fuel injectors for missed pulses. In an example, a method is presented for operating a fuel injection system for an engine assembly. The engine assembly includes multiple cylinders (e.g., 4, 5, 6, 8, etc., arranged I-type, V-type, etc.), multiple pistons each reciprocally movable in a respective one of the cylinders (e.g., in a four-stroke, spark-ignited configuration), and multiple fuel injectors (e.g., PFI injectors or PFI and DI injectors) operable to inject multiple pulses of fuel per combustion cycle to an engine cylinder. This representative method includes, in any order and in any combination with any of the above and below disclosed options and features: determining, e.g., via a resident controller, a remote controller, or a network of resident/remote controllers (collectively "controller") communicating with a powertrain control module (PCM), if the fuel injectors are operating in a multi-pulse mode for actively injecting multiple fuel pulses per combustion cycle per cylinder; monitoring, e.g., via the controller responsive to determining the fuel injectors are operating in the multi-pulse mode, pulse signals being transmitted to the fuel injectors to inject the multiple pulses per combustion cycle for multiple combustion cycles; identifying, e.g., via the controller for each fuel injector for each combustion cycle, a cylinder misfire if any one or more or all of the pulses of that combustion cycle is missed; determining, e.g., via the controller for each of the cylinders, a misfire ratio of a total number of cylinder misfires to a total number of combustion cycles; and transmitting, e.g., via the controller responsive to any one of the misfire ratios exceeding a calibrated misfire limit, one or more command signals to one or more resident subsystems to execute one or more automated control operations designed to mitigate the excessive cylinder misfires.

Aspects of this disclosure are also directed to computer-readable media (CRM) for detecting missed fuel injector pulses. In an example, a non-transitory CRM stores instructions executable by one or more processors of a resident or remote engine controller or controller network. These instructions, when executed by the processor(s), cause the controller to perform operations, including: determining if the fuel injectors are operating in a multi-pulse mode to actively inject multiple pulses of fuel per combustion cycle to the cylinders; monitoring, responsive to determining the fuel injectors are operating in the multi-pulse mode, pulse signals transmitted to the fuel injectors to inject the multiple pulses of fuel per combustion cycle for multiple combustion cycles; identifying, for each of the fuel injectors for each of the combustion cycles, a cylinder misfire if any one of the multiple pulses of the combustion cycle is missed; determining, for each of the cylinders, a misfire ratio of a total number of the cylinder misfires to a total number of the combustion cycles; and transmitting, responsive to any one of the misfire ratios exceeding a calibrated misfire limit, a command signal to a resident subsystem to execute an automated control operation configured to mitigate the cylinder misfires.

Additional aspects of this disclosure are directed to motor vehicles employing multi-pulse fuel injection systems with attendant control logic for monitoring engine fuel injectors for missed pulses. As used herein, the terms "vehicle" and "motor vehicle" may be used interchangeably and synonymously to reference any relevant vehicle platform, such as passenger vehicles (ICE, HEV, fuel cell, fully and partially autonomous, etc.), commercial vehicles, industrial vehicles, tracked vehicles, off-road and all-terrain vehicles, motorcycles, farm equipment, watercraft, aircraft, etc. In an example, a motor vehicle includes a vehicle body with a passenger compartment, multiple road wheels mounted to the vehicle body (e.g., via corner modules coupled to a unibody or body-on-frame chassis), and other standard original equipment. An engine assembly operates alone (e.g., for ICE powertrains) or in conjunction with one or more electric traction motors (e.g., for HEV powertrains) to selectively drive one or more of the road wheels to propel the vehicle. The vehicle also includes a fuel injection system with multiple fuel injectors, each of which is operable to inject multiple pulses of fuel per combustion cycle to a respective one of the engine cylinders.

Continuing with the preceding discussion, the vehicle is also equipped with an electronic engine controller (e.g., single controller, network of controllers, resident/remote controller devices, etc.) that is programmed to determine if the fuel injectors are operating in a multi-pulse mode to actively inject multiple pulses of fuel per combustion cycle per cylinder and, if so, responsively monitor the pulse signals being transmitted to the fuel injectors to inject the multiple fuel pulses/cycle for multiple combustion cycles. While monitoring these pulse signals, the controller flags a cylinder misfire, i.e., for each fuel injector for each cycle, each time any one of the fuel pulses of a combustion cycle is missed. From these flagged misses, the controller determines a misfire ratio of a total number of the cylinder misfires to a total number of the combustion cycles for each cylinder. Responsive to any one of these misfire ratios exceeding a predefined, engine-calibrated misfire limit, the controller commands one or more resident vehicle subsystems to execute one or more automated control operations to mitigate the cylinder misfires.

For any of the disclosed systems, methods, and vehicles, monitoring the pulse signals being transmitted to the fuel injectors may include tracking electrical signals that are generated by a driver submodule in the controller and then output from the controller to the fuel injectors. In order to identify cylinder misfires, the controller may actively detect if any of the injector pulses is missed by determining, for each tracked electrical signal, a substantially equivalent electrical signal is not received at nor output by a corresponding one of the fuel injectors. As another option, a single combustion cycle may include at least three fuel pulses; in this instance, a cylinder misfire is identified when any one or more or all of the first, second, and third pulses is missed.

For any of the disclosed systems, methods, and vehicles, the controller may store, in a resident or remote memory device for each engine cylinder, a respective failure counter that tracks the total number of cylinder misfires of that cylinder. In this instance, the controller increments the failure counter each time that cylinder experiences a cylinder misfire. At the same time, the controller may store, in a resident or remote memory device for each cylinder, a respective combustion event counter that tracks the total number of combustion cycles of that cylinder. In this instance, the controller increments the combustion event counter each time that cylinder completes a combustion cycle. The controller may also store, in memory for each cylinder, a respective missed pulse counter that tracks the total number of missed pulses of that cylinder. In this instance, the controller increments the missed pulse counter each time that cylinder misses one of the fuel pulses over the course of the multiple combustion cycles.

For any of the disclosed systems, methods, and vehicles, the resident subsystem may include a port fuel injection system with multiple PFI injectors. In this instance, the misfire-mitigating command signal(s) output by the controller cause the PFI system to provisionally disable the corresponding PFI injector for each engine cylinder whose misfire ratio exceeds the calibrated misfire limit. In this regard, the fuel injection system may temporarily disable one, some, or all of the PFI injectors, may temporarily disable multi-pulse fuel injection, and/or may activate a "limp home" mode for the engine assembly. As another option, the resident subsystem may include an engine diagnostics module (EDM); the command signal causes the EDM to set a diagnostic code. For vehicular applications, the resident subsystem may also include an electronic display device and/or an audio component located inside the vehicle passenger compartment. In this instance, the command signal causes the display device and/or audio component to display/output a corresponding user notification indicating engine service may be needed.

For any of the disclosed systems, methods, and vehicles, the controller may transmit injector-on command signals to power on the fuel injectors prior to determining if the fuel injectors are in a multi-pulse operating mode (e.g., multi-pulse injector monitoring is triggered when the fuel injectors are powered on). As another option, the engine's fuel injection system may include both DI injectors, which are operable to inject fuel directly into the cylinders, and PFI injectors, which are operable to indirectly inject fuel to the cylinders via the engine's intake runners and intake ports. In this instance, the multi-pulse mode may include an operating mode in which both the DI injectors and the PFI injectors jointly inject fuel into the cylinders for the combustion cycles. As noted above, the engine controller may take on many form factors, including a single or multiple resident/remote controller devices and/or network of controller devices. Moreover, the controller may take on the form of a dedicated engine control module that contains an ECM driver submodule and an ECM monitor submodule. In this instance, the ECM driver submodule transmits the pulse signals to the fuel injectors to inject the multiple fuel pulses/cylinder/cycle, whereas the ECM monitor submodule monitors the pulse signals and detects the cylinder misfires, if any, during the monitored multi-pulse combustion cycles.

The above summary does not represent every embodiment or every aspect of the present disclosure. Rather, the foregoing summary merely provides a synopsis of some of the novel concepts and features set forth herein. The above features and advantages, and other features and attendant advantages of this disclosure, will be readily apparent from the following Detailed Description of illustrated examples and representative modes for carrying out the disclosure when taken in connection with the accompanying drawings and appended claims. Moreover, this disclosure expressly includes any and all combinations and subcombinations of the elements and features presented above and below.

Figure 1:
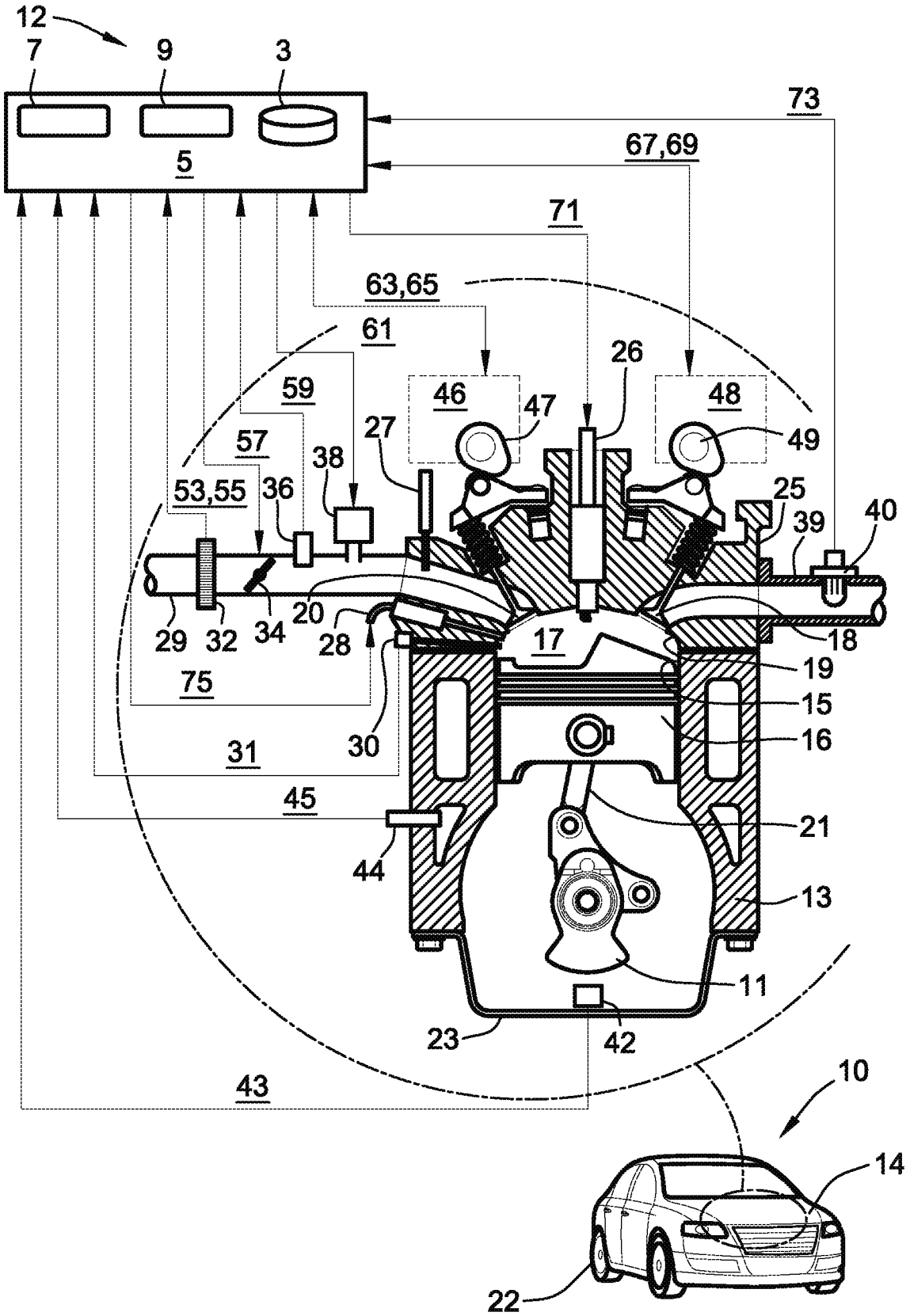
FIG. 1 is a front, perspective-view illustration of a representative motor vehicle with an inset schematic illustration of a representative reciprocating-piston type internal combustion engine assembly with a hybrid PFI-DI fuel injection system with multi-pulse injector monitoring capabilities in accordance with aspects of the present disclosure.

The present disclosure is amenable to various modifications and alternative forms, and some representative embodiments of the disclosure are shown by way of example in the drawings and will be described in detail herein. It should be understood, however, that the novel aspects of this disclosure are not limited to the particular forms illustrated in the above-enumerated drawings. Rather, this disclosure covers all modifications, equivalents, combinations, permutations, groupings, and alternatives falling within the scope of this disclosure as encompassed, for example, by the appended claims.

DETAILED DESCRIPTION

This disclosure is susceptible of embodiment in many different forms. Representative embodiments of the disclosure are shown in the drawings and will herein be described in detail with the understanding that these embodiments are provided as an exemplification of the disclosed principles, not limitations of the broad aspects of the disclosure. To that extent, elements and limitations that are described, for example, in the Abstract, Introduction, Summary, and Detailed Description sections, but not explicitly set forth in the claims, should not be incorporated into the claims, singly or collectively, by implication, inference or otherwise.

For purposes of the present detailed description, unless specifically disclaimed: the singular includes the plural and vice versa; the words "and" and "or" shall be both conjunctive and disjunctive; the words "any" and "all" shall both mean "any and all"; and the words "including," "containing," "comprising," "having," and the like, shall each mean "including without limitation." Moreover, words of approximation, such as "about," "almost," "substantially," "generally," "approximately," and the like, may each be used herein in the sense of "at, near, or nearly at," or "within 0-5% of," or "within acceptable manufacturing tolerances," or any logical combination thereof, for example. Lastly, directional adjectives and adverbs, such as fore, aft, inboard, outboard, starboard, port, vertical, horizontal, upward, downward, front, back, left, right, etc., may be with respect to a motor vehicle, such as a forward driving direction of a motor vehicle when the vehicle is operatively oriented on a horizontal driving surface.

Referring now to the drawings, wherein like reference numbers refer to like features throughout the several views, there is shown in FIG. 1 a perspective-view illustration of a representative automobile, which is designated generally at 10 and portrayed herein for purposes of discussion as a gas-powered, sedan-style passenger vehicle. The illustrated automobile 10—also referred to herein as "motor vehicle" or "vehicle" for short—is merely an exemplary application with which novel aspects of this disclosure may be practiced. In the same vein, implementation of the present concepts into a four-stroke gasoline engine should also be appreciated as an exemplary application of the novel concepts disclosed herein. As such, it will be understood that features of the present disclosure may be applied to other engine configurations, incorporated into alternative powertrain architectures, and utilized for any logically relevant type of motor vehicle. Lastly, only select components of the motor vehicle and internal combustion engine assembly have been shown and will be described in additional detail herein. Nevertheless, the vehicles and engines discussed below may include numerous additional and alternative features, and other available peripheral components for carrying out the various methods and functions of this disclosure.

FIG. 1 illustrates an example of a dual overhead cam (DOHC), inline-type spark-ignited (SI) internal combustion engine assembly 12 that is mounted inside an engine bay 14 of the vehicle body. The illustrated ICE assembly 12 is a four-stroke, reciprocating-piston engine configuration that operates to propel the vehicle 10, for example, as a direct injection (DI) and port fuel injection (PFI) gasoline engine, including flexible-fuel vehicle (FFV) and hybrid electric vehicle (HEV) variations thereof. The engine assembly 12 can optionally operate in any of an assortment of selectable combustion modes, including a homogeneous-charge compression-ignition (HCCI) combustion mode and an adjustable-lift spark-ignition (SI) combustion mode. Although not explicitly portrayed in FIG. 1, it is envisioned that the vehicle driveline may take on any available configuration, including front wheel drive (FWD) layouts, rear wheel drive (RWD) layouts, all-wheel drive (AWD) layouts, four-wheel drive (4WD) layouts, etc.

The engine assembly 12 employs a series of reciprocating pistons 16, each of which is slidably movable within a respective one of the mutually parallel cylinder bores 15 in an engine block 13. Engine pistons 16 are typically provided in even numbers of 4, 6, 8, etc., and arranged in a V-type or I-type configuration; however, disclosed concepts are similarly applicable to cylinder counts (e.g., 3, 5, etc.) and layouts (e.g., H-type, rotary, etc.). The top surface of each piston 16 cooperates with the inner periphery of its corresponding cylinder 15 and a respective chamber surface 19 of a cylinder head 25 to define a variable-volume combustion chamber 17. Each piston 16 is connected by a respective connecting rod 21 and optional linkages to a crankpin of a rotating crankshaft 11. The crankshaft 11, in turn, transforms the linear reciprocating motion of the pistons 16 to rotational motion that is output, for example, as a number of rotations per minute (RPM) to a power transmission (not shown) to drive one or more road wheels 22. The crankshaft 11 is shown packaged within a crankcase 23 mounted underneath the engine block 13. While shown as discrete parts, the engine block 13 and cylinder head 25 may be integrally formed as single-piece, unitary "monobloc" construction.

An air intake system transmits intake air to the cylinders 15 through an intake manifold 29, which directs and distributes air into the individual combustion chambers 17 via respective intake runners and intake ports of the cylinder head 25. The engine's air intake system has airflow ductwork and various electronic devices for monitoring and regulating incoming air flow. The air intake devices can include, as a non-limiting example, a mass airflow sensor 32 for monitoring mass airflow (MAF) 53 and intake air temperature (IAT) 55. A throttle valve 34 controls airflow to the engine assembly 12 in response to an engine throttle control (ETC) signal 57 from a programmable engine control unit (ECU) 5, which may be embodied as an electronic engine control module (ECM) that contains both an ECM driver submodule 7 and an ECM monitor submodule 9. A pressure sensor 36 in the intake manifold 29 monitors, for instance, manifold absolute pressure (MAP) 59 and barometric pressure.

To reduce engine emissions and modulate peak in-cylinder temperatures, an optional external flow passage (not shown) may recirculate finite amounts of exhaust gases in engine exhaust from an exhaust manifold 39 to the intake manifold 29. The engine assembly 12 employs an exhaust gas recirculation (EGR) valve 38 to meter the volume of recirculated exhaust introduced back into the cylinders 15. The programmable engine control unit (or "ECM") 5 controls mass flow of exhaust gas to the intake manifold 29 by controlling the opening/closing of the EGR valve 38 via EGR command 61. In FIG. 1, the arrows connecting ECU 5 with the various components of the engine assembly 12 are emblematic of electronic signals or other communication exchanges by which data and/or control commands are transmitted from one component to the other.

Airflow from the intake manifold 29 into the combustion chamber 17 is controlled by one or more intake engine valves 20. Evacuation of exhaust gases out of the combustion chamber 17 to the exhaust manifold 39 is controlled by one or more exhaust engine valves 18. These engine valves 18, 20 are illustrated herein as spring-biased poppet valves; however, other commercially available types of engine valves may be employed. In FIG. 1, the engine assembly 12 employs a valve train system that is equipped to control and adjust the opening and closing of the exhaust and intake engine valves 18, 20. While shown with a single pair of engine valves, it should be appreciated that each cylinder 15 may be equipped with multiple pairs of intake/exhaust engine valves.

Activation of the engine valves 18, 20 may be modulated by controlling exhaust and intake variable cam phasing/variable lift control (VCP/VLC) devices 46 and 48. These VCP/VLC devices 46, 48 are operable to control an intake camshaft 47 and an exhaust camshaft 49. Rotation of the intake and exhaust camshafts 47, 49 are linked and indexed to rotation of the crankshaft, thus linking the opening and closing of the intake and exhaust valves 20, 18 to positions of the crankshaft 11 and the pistons 16. The intake VCP/VLC device 46 may variably switch and control valve lift of the intake valve(s) 20 in response to an intake variable lift control (iVLC) signal 63, and variably adjust and control phasing of the intake camshaft 47 for each cylinder 15 in response to an intake variable phasing control (iVCP) signal 65. Exhaust VCP/VLC device 48 may variably switch and control valve lift of the exhaust valve(s) 18 in response to an exhaust variable lift control (eVLC) signal 67, and variably adjust and control phasing of the exhaust camshaft 49 for each cylinder 15 in response to an exhaust variable phasing control (eVCP) signal 69.

With continuing reference to the representative configuration of FIG. 1, engine assembly 12 employs a hybrid PFI-DI fuel injection system with multiple high-pressure electronic PFI and DI fuel injectors 27 and 28, respectively, that inject pulses of fuel both indirectly and directly into the combustion chambers 17. As shown, each cylinder 15 is provided with a pair of fuel injectors 27, 28 that activates, individually and jointly, in response to injector pulse width command (INJ_PW) signals 75 from the ECU 5. These fuel injectors 27, 28 are supplied with pressurized fuel by a fuel distribution system. The fuel injectors 27, 28 may be operable, when activated, to inject multiple fuel pulses per working combustion cycle into a corresponding one of the engine cylinders 15. Engine assembly 12 employs a compression-ignition procedure (for diesel engine architectures) or a spark-ignition procedure (for gasoline engine architectures) by which fuel-combustion-initiating energy, such as an abrupt electrical discharge provided via a spark plug 26 in response to a spark ignition (IGN) signal 71, ignites cylinder charges in the combustion chambers 17. Fuel injectors 27, 28 may also take on the form of an electronically controlled, common-rail fuel injector architecture that operates with a normally-off solenoid-driven mode of operation.

In accord with the illustrated example, each DI fuel injector 28 is packaged within the cylinder head 25 (or, alternatively, in the engine block 13) and directly fluidly coupled to the combustion chamber 17 to selectively inject fuel directly into the chamber 17. By comparison, each PFI fuel injector 27 is packaged within the cylinder head 25 (or, alternatively, on the intake manifold 29) and directly fluidly coupled to the intake runner upstream from the intake port to selectively inject fuel indirectly to the combustion chamber 17, e.g., when the intake valve 20 is open. In various embodiments, among other functionality, the ECU 5 selectively controls operation of the PFI injectors 27 and the DI injectors 28, including respective percentages of fuel provided therefrom to the combustion chambers 17, e.g., to optimize performance for the engine 12 in terms of torque, fuel economy, and/or other application-specific factors. As described in further detail below, the ECU 5 provides these and related functions in accordance with the steps of the process 100 described in connection with the controller-executable algorithm of FIG. 2.

The engine assembly 12 is equipped with a variety of sensing devices for monitoring engine operation, including a crank sensor 42 that monitors crankshaft rotational position and outputs a crank angle/speed (RPM) signal 43. A temperature sensor 44 monitors, for example, one or more engine-related temperatures (e.g., coolant temp, oil, etc.) and outputs a signal 45 indicative thereof. An in-cylinder combustion sensor 30 monitors combustion-related variables, such as in-cylinder combustion pressure, charge temperature, fuel mass, air-to-fuel ratio, etc., and outputs a signal 31 indicative thereof. An exhaust gas sensor 40 monitors one or more exhaust gas-related variables, e.g., actual air/fuel ratio (AFR), burned gas fraction, etc., and outputs a signal 73 indicative thereof.

Figure 2:
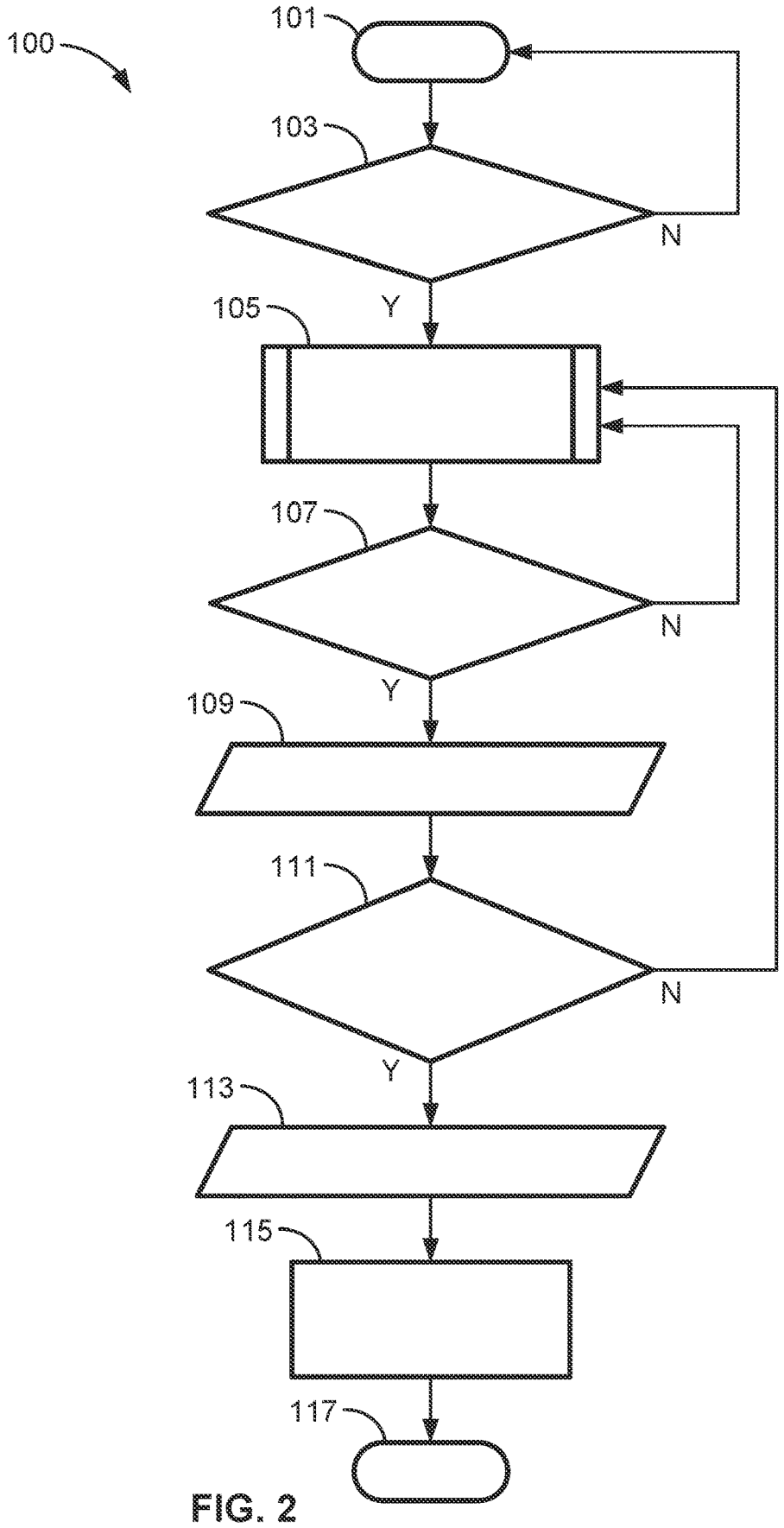
FIG. 2 is a flowchart illustrating a representative pulse monitoring protocol for detecting and mitigating missed injector pulses in a multi-pulse fuel injection system, which may correspond to memory-stored instructions that are executable by a resident or remote controller, control-logic circuit, programmable control unit, or other integrated circuit (IC) device or network of devices in accord with aspects of the disclosed concepts.

With reference next to the flow chart of FIG. 2, an improved method or control strategy for automated fuel pulse monitoring for detecting and mitigating missed injector pulses in a multi-pulse fuel injection system of an engine assembly, such as ICE assembly 12 of FIG. 1, is generally described at 100 in accordance with aspects of the present disclosure. Some or all of the operations illustrated in FIG. 2 and described in further detail below may be representative of an algorithm that corresponds to non-transitory, processor-executable instructions that are stored, for example, in main or auxiliary or remote memory (e.g., memory device 3 of FIG. 1), and executed, for example, by an electronic controller, processing unit, logic circuit, or other module or device or network of modules/devices (e.g., engine control unit 5 of FIG. 1), to perform any or all of the above and below described functions associated with the disclosed concepts. It should be recognized that the order of execution of the illustrated operation blocks may be changed, additional operation blocks may be added, and some of the herein described operation blocks may be modified, combined, or eliminated.

Method 100 begins at START terminal block 101 of FIG. 2 with memory-stored, processor-executable instructions for a programmable controller or control module or similarly suitable processor to call up an initialization procedure for an injector fuel pulse monitoring protocol. This routine may be executed in real-time, near real-time, continuously, systematically, sporadically, and/or at regular intervals, for example, each 10 or 100 milliseconds during regular and routine operation of the motor vehicle 10. As yet another option, terminal block 101 may initialize responsive to a user command prompt (e.g., via center-stack telematics or dashboard instrument cluster input controls), a resident vehicle controller prompt (e.g., from ECU 5), or a broadcast prompt signal received from a centralized back-office (BO) vehicle services system (e.g., ONSTAR®). By way of non-limiting example, the method 100 may automatically initialize in response to detection of a user keying-on the host vehicle 10 with a concomitant cranking of the engine assembly 12, the vehicle PCM switching to a driving mode that employs multi-pulse fuel injection, and/or the ECU 5 transmitting injector-on command signals to power on the PFI fuel injectors 27 and, if desired, the DI fuel injectors 28.

In a specific, yet purely representative instance, current engine operating conditions may be monitored in real-time to determine if the vehicle is executing a transient engine operation (e.g., tip-in to rapid acceleration) or the engine is operating at or above a key part-load operation (2000+ RPM and 5+ Bar BMEP). For either case, a predefined, multi-pulse fuel injection control protocol may be retrieved from memory-stored lookup tables and implemented to help improve overall engine operation. DI and/or PFI injection of multiple fuel pulses per cylinder per combustion cycle may also be desirable in specifically designated "special operation" regimes, e.g., to facilitate rapid catalytic converter light-off and/or to mitigate engine combustion noise (e.g., "engine knocking"). Upon completion of some or all of the control operations presented in FIG. 2, the method 100 may advance to END terminal block 117 and temporarily terminate or, optionally, may loop back to terminal block 101 and run in a continuous loop.

After initializing the pulse monitoring protocol, method 100 advances to ACTIVE MULTI-PULSE INJECTION decision block 103 to determine if one or more or all of an engine assembly's fuel injectors are actively operating in a multi-pulse mode. For example, the ECU 5 may assess whether or not the PFI injectors 27 are operating in a multi-pulse mode to actively inject multiple pulses of fuel per combustion cycle per cylinder into the cylinders 15 of engine assembly 12. An example of a multi-pulse operating mode may include both the DI injectors 28 and the PFI injectors 27 working in unison to inject fuel (e.g., a pilot pulse followed by a main pulse followed by one or more post pulses) into the cylinders 15 for each cycle in a series of combustion cycles. ECU 5 of FIG. 1 may verify that the PFI fuel injectors 27 are active by tracking, in real-time or near real-time, the ECM driver submodule 7 outputting corresponding command signals to activate the PFI injectors 27 in accord with a predefined injection profile associated with a multi-pulse mode. If it is determined that the PFI injectors 27 are not active (Block 103=NO), method 100 may loop back to terminal block 101 and run in a continuous loop until the engine assembly 12 is keyed off or, alternatively, may proceed to terminal block 117 and temporarily terminate.

Upon determining that one or more of the engine assembly's fuel injectors are actively operating in a multi-pulse mode (Block 103=YES), method 100 responsively executes MULTI-PULSE MONITORING subroutine process block 105 to actively monitor commanded injector pulses. By way of example, when the ECU 5 is operating the PFI fuel injectors 27 in a multi-pulse mode, the ECM monitor submodule 9 may actively track commanded pulse signals as they are being output by the ECM driver submodule 7 to the PFI injectors 27 to inject multiple fuel pulses per combustion cycle per cylinder for multiple sequential combustion cycles. The ECM monitor submodule 9 of FIG. 1 may continually track one or more electrical characteristics (e.g., signal output voltage, signal output current, signal output timing, etc.) of the corresponding electrical signals generated by the driver submodule 7 and output from the ECM 5 to the fuel injectors 27.

With continuing reference to FIG. 2, method 100 proceeds to MISSING INJECTOR PULSE decision block 107 to determine if any of the commanded fuel pulses are missed during the multi-pulse operating mode. For each PFI fuel injector 27 of each cylinder 15 for each combustion cycle, the ECU 5 may: (1) detect if any of the commanded fuel pulses is missed; and (2) identify a cylinder misfire for each combustion cycle in which any one of the commanded pulses of that cycle is missed. A missed fuel pulse may be detected by determining, for each electrical signal output by the ECM driver submodule 7 and tracked by the ECM monitor submodule 9 using upstream and/or downstream electrical feedback sensors, that a substantially equivalent electrical signal is not received at nor output by the intended PFI fuel injector 27. The ECM monitor submodule 9 may actively track the individual driver-generated command signals output from the ECM 5 and transmitted to the PFI injectors 27 to ascertain whether or not a corresponding signal is received by the injectors 27 (e.g., on-block sensor detects no spike or a reduced spike, which may be deemed a missed pulse).

Table 1 shows an example of a fuel injection pulse log for a representative engine assembly with four cylinders—labelled cylinders ("Cyl") A, B, C and D—and a hybrid PFI-DI fuel system with a single dedicated PFI injector for each cylinder. In this example, each PFI injector was instructed to inject three pulses of fuel per combustion cycle for five consecutive combustion cycles. Table 1 labels each successfully completed pulse as "PFI" and labels each missed pulse with an "X". The first cylinder (Cyl A) experienced a single missed fuel pulse in each of the 4th and 5th combustion cycles, whereas the second cylinder (Cyl B) experienced two missed fuel pulses in each of the 3rd, 4th and 5th combustion cycles, the third cylinder (Cyl C) missed all three fuel pulses in only the 4th combustion cycle, and the fourth cylinder (Cyl D) did not experience any missed fuel pulses for the five combustion cycles. If none of the monitored fuel injectors experiences a missed fuel pulse over the course of the monitored combustion cycles (Block 107=NO), the method 100 may loop back to subroutine process block 105 and continue monitoring injector pulse commands for future combustion events.

Responsive to detecting one or more missed fuel pulses during a multi-pulse operating mode (Block 107=YES), method 100 of FIG. 2 responsively executes COUNT FAILURE data input/output block 109 to track cylinder misfires within the engine assembly. In accord with this disclosure, a cylinder misfire may be typified by a fuel injector missing any one or more or all of the commanded pulses in a given combustion cycle. Count failure tracking may include the ECM 5 storing an individual failure counter for each engine cylinder 15 in memory device 3; each failure counter tracks the total number of cylinder misfires of a corresponding cylinder. In this instance, the failure counter is incremented each time that cylinder experiences a cylinder misfire. In addition, the ECM 5 may store a respective combustion event counter for each cylinder 5 in the memory device 3; this counter tracks the total number of combustion cycles monitored for that cylinder. To that end, the ECM 5 increments a combustion event counter each time its corresponding cylinder completes a combustion cycle. At the same time, the ECM 5 may also store a missed pulse counter for each cylinder 15 in memory device 3; each missed pulse counter tracks the total number of missed pulses experienced by its corresponding cylinder. The missed pulse counter is incremented each time its associated cylinder misses a fuel pulse.

TABLE 2

| | Number of missing pulses | Number of cylinder misfires | Number of combustion events | Fail % |
|---|---|---|---|---|
| Cyl A | 2 | 2 | 5 | 40% |
| Cyl B | 6 | 3 | 5 | 60% |
| Cyl C | 3 | 1 | 5 | 20% |
| Cyl D | 0 | 0 | 5 | 0% |

Table 2 shows an example of a cylinder misfire log for the representative 4-cylinder ICE assembly discussed above with respect to Table 1. The first column of Table 2 shows the missed pulse counter for each cylinder; as noted above, the first cylinder (Cyl A) experienced a total of two missed pulses over the course of five combustion cycles, the second cylinder (Cyl B) experienced a total of four missed pulses during the same five cycles, the third cylinder (Cyl C) experienced a total of three missed pulses for these same cycles, and the fourth cylinder (Cyl D) did not experience any missed fuel pulses. The second column of Table 2 shows the failure counter for each cylinder; in this example, the first cylinder (Cyl A) experienced a total of two cylinder misfires (Combustions 4 and 5) over the course of five combustion cycles, the second cylinder (Cyl B) experienced a total of three cylinder misfires during the same five cycles (Combustions 3, 4 and 5), the third cylinder (Cyl C) experienced a total of one cylinder misfires for these combustion cycles (Combustion 4), and the fourth cylinder (Cyl D) did not experience any cylinder misfires. The third column of Table 2 shows the combustion event counters for all four cylinders; as shown in Table 1, all four cylinders underwent five consecutive 3-pulse combustion cycles.

TABLE 1

| | Combustion 1 | | | Combustion 2 | | | Combustion 3 | | | Combustion 4 | | | Combustion 5 | | |
|---|---|---|---|---|---|---|---|---|---|---|---|---|---|---|---|
| Cyl A | PFI | PFI | PFI | PFI | PFI | PFI | PFI | PFI | PFI | PFI | PFI | X | PFI | PFI | X |
| Cyl B | PFI | PFI | PFI | PFI | PFI | PFI | PFI | X | X | PFI | X | X | PFI | X | X |
| Cyl C | PFI | PFI | PFI | PFI | PFI | PFI | PFI | PFI | PFI | X | X | X | PFI | PFI | PFI |
| Cyl D | PFI | PFI | PFI | PFI | PFI | PFI | PFI | PFI | PFI | PFI | PFI | PFI | PFI | PFI | PFI |

Method 100 advances from data block 109 to EXCESSIVE MISFIRE decision block 113 of FIG. 2 to determine if the ratio of failures to cycles exceeds a calibratable limit. For instance, ECM 5 of FIG. 1 may calculate a misfire ratio for each of the cylinders 15 or just those cylinders that experience at least one missed fuel pulse in a series of multi-pulse combustion cycles during a multi-pulse operating mode. A misfire ratio is the ratio of total number of the cylinder misfires to total number of combustion cycles for a respective cylinder. In Table 2, for example, the misfire ratios are as follows: (1) Cyl A=2:5 (40% fail percentage); (2) Cyl B=3:5 (60% fail percentage); (3) Cyl C=1:5 (20% fail percentage); and (4) Cyl D=0:5 (0% fail percentage). In this example, the calibrated misfire limit may be set as a memory-stored, predefined maximum allowable percentage value (e.g., 20% max fails) or ratio value (e.g., 2:5 max fails) calibrated to the subject engine assembly. It should be appreciated that process blocks 105, 107, 109 and 111 may be executed sequentially (as shown) or substantially simultaneously with each other (e.g., during or immediately after a multi-pulse operating mode). If none of the misfire ratios exceeds the calibratable limit (Block 113=NO), the method 100 may loop back to subroutine process block 105 and continue monitoring injector pulse commands for future combustion events; otherwise, method 100 may terminate at Block 117.

Upon determining that a misfire ratio exceeds the predefined calibratable limit (Block 113=YES), the method 100 responsively automates ameliorative action to remediate the excessive misfires. The engine control unit 5 of FIG. 1, for example, may be programmed to counter any one of the misfire ratios exceeding the calibrated misfire limit by commanding one or more resident vehicle subsystems to execute one or more automated control operations designed to help mitigate the cylinder misfires. In an example, the ECM 5 contains an engine diagnostics module (EDM) that sets a diagnostic code for the excessive misfires and stores related data (e.g., number of missed pulses, magnitude of misfire ratio; cylinder number, PFI injector identifier, timestamp, etc.), as indicated at SET DIAGNOSTIC CODE data input/output block 113. At the same time, an electronic display device and/or an audio component located inside the vehicle passenger compartment may output a visual and/or audible user notification indicating engine service may be needed.

In another example, the ECM 5 outputs command signals to the engine's port fuel injection system that causes the PFI system to temporarily disable the PFI injector 27 for each cylinder 15 with a misfire ratio that exceeds the calibrated misfire limit, as indicated at DISABLE PFI operation block 115. At the same time, the ECM 5 may temporarily disable all of the PFI injectors 27 (i.e., activate a DI-only operating mode), temporarily disable multi-pulse fuel injection across both the PFI injectors 27 and the DI injectors 28, and/or may activate a "limp home" mode (e.g., disabling in-vehicle accessories and setting a maximum engine output to 2000 RPM). Another non-limiting option may include a resident Displacement on Demand (DoD) module deactivating the engine cylinders that have experienced excessive cylinder misfire so long as there is a sufficient number of active cylinders to propel the hose vehicle.

Aspects of this disclosure may be implemented, in some embodiments, through a computer-executable program of instructions, such as program modules, generally referred to as software applications or application programs executed by any of a controller or the controller variations described herein. Software may include, in non-limiting examples, routines, programs, objects, components, and data structures that perform particular tasks or implement particular data types. The software may form an interface to allow a computer to react according to a source of input. The software may also cooperate with other code segments to initiate a variety of tasks in response to data received in conjunction with the source of the received data. The software may be stored on any of a variety of memory media, such as CD-ROM, magnetic disk, and semiconductor memory (e.g., various types of RAM or ROM).

Moreover, aspects of the present disclosure may be practiced with a variety of computer-system and computer-network configurations, including multiprocessor systems, microprocessor-based or programmable-consumer electronics, minicomputers, mainframe computers, and the like. In addition, aspects of the present disclosure may be practiced in distributed-computing environments where tasks are performed by resident and remote-processing devices that are linked through a communications network. In a distributed-computing environment, program modules may be located in both local and remote computer-storage media including memory storage devices. Aspects of the present disclosure may therefore be implemented in connection with various hardware, software, or a combination thereof, in a computer system or other processing system.

Any of the methods described herein may include machine readable instructions for execution by: (a) a processor, (b) a controller, and/or (c) any other suitable processing device. Any algorithm, software, control logic, protocol or method disclosed herein may be embodied as software stored on a tangible medium such as, for example, a flash memory, a solid-state drive (SSD) memory, a hard-disk drive (HDD) memory, a CD-ROM, a digital versatile disk (DVD), or other memory devices. The entire algorithm, control logic, protocol, or method, and/or parts thereof, may alternatively be executed by a device other than a controller and/or embodied in firmware or dedicated hardware in an available manner (e.g., implemented by an application specific integrated circuit (ASIC), a programmable logic device (PLD), a field programmable logic device (FPLD), discrete logic, etc.). Further, although specific algorithms may be described with reference to flowcharts and/or workflow diagrams depicted herein, many other methods for implementing the example machine-readable instructions may alternatively be used.

Aspects of the present disclosure have been described in detail with reference to the illustrated embodiments; those skilled in the art will recognize, however, that many modifications may be made thereto without departing from the scope of the present disclosure. The present disclosure is not limited to the precise construction and compositions disclosed herein; any and all modifications, changes, and variations apparent from the foregoing descriptions are within the scope of the disclosure as defined by the appended claims. Moreover, the present concepts expressly include any and all combinations and subcombinations of the preceding elements and features.

What is claimed:

1. A method of operating a fuel injection system for an engine assembly, the engine assembly including multiple cylinders, multiple pistons each reciprocally movable in a respective one of the cylinders, and multiple fuel injectors each operable to inject multiple pulses of fuel per combustion cycle to a respective one of the cylinders, the method comprising:

determining, via an engine controller, if the fuel injectors are operating in a multi-pulse mode to actively inject multiple pulses of fuel per combustion cycle to the cylinders;

monitoring, via the engine controller responsive to determining the fuel injectors are operating in the multi-pulse mode, pulse signals transmitted to the fuel injectors to inject the multiple pulses of fuel per combustion cycle for multiple combustion cycles;

identifying, for each of the fuel injectors for each of the combustion cycles, a cylinder misfire if any one of the multiple pulses of the combustion cycle is missed;

determining, via the engine controller for each of the cylinders, a misfire ratio of a total number of the cylinder misfires to a total number of the combustion cycles; and transmitting, via the engine controller responsive to any one of the misfire ratios exceeding a calibrated misfire limit, a command signal to a resident subsystem to execute an automated control operation configured to mitigate the cylinder misfires.

2. The method of claim 1, wherein monitoring the pulse signals transmitted to the fuel injectors includes tracking electrical signals generated by a driver submodule in the engine controller and output from the engine controller to the fuel injectors.

3. The method of claim 2, further comprising detecting if any of the multiple pulses is missed by determining, for each of the tracked electrical signals, a substantially equivalent electrical signal is not received at nor output by a corresponding one of the fuel injectors.

4. The method of claim 1, wherein the multiple pulses of fuel per combustion cycle includes at least first, second, and third pulses, and wherein identifying the cylinder misfire includes any one or more or all of the first, second, and third pulses being missed.

5. The method of claim 1, further comprising:

storing, in a memory device for each of the cylinders, a respective failure counter tracking the total number of cylinder misfires of the cylinder; and incrementing the respective failure counter each time the cylinder experiences one of the cylinder misfires.

6. The method of claim 5, further comprising:

storing, in the memory device for each of the cylinders, a respective combustion event counter tracking the total number of combustion cycles of the cylinder; and incrementing the respective combustion event counter each time the cylinder completes one of the combustion cycles.

7. The method of claim 6, further comprising:

storing, in the memory device for each of the cylinders, a respective missed pulse counter tracking a total number of missed pulses of the cylinder; and incrementing the respective missed pulse counter each time the cylinder misses one of the pulses of fuel.

8. The method of claim 1, wherein the resident subsystem includes a port fuel injection (PFI) system of the fuel injection system, the fuel injectors include multiple PFI injectors, and the command signal causes the PFI system to disable the PFI injector for each of the cylinders in which the misfire ratio exceeds the calibrated misfire limit.

9. The method of claim 1, wherein the resident subsystem includes an engine diagnostics module (EDM), and the command signal causes the EDM to set a diagnostic code with a corresponding user notification indicating engine service is needed.

10. The method of claim 1, further comprising transmitting, via the engine controller to the fuel injectors prior to determining if the fuel injectors are operating in the multi-pulse mode, injector-on command signals to power on the fuel injectors.

11. The method of claim 1, wherein the engine assembly further includes intake ports fluidly connected to the cylinders and direct injection (DI) injectors operable to inject fuel directly into the cylinders, wherein the fuel injectors include port fuel injection (PFI) injectors operable to indirectly inject fuel to the cylinders via the intake ports, and wherein the multi-pulse mode includes both the DI injectors and the PFI injectors jointly injecting fuel into the cylinders for the combustion cycles.

12. The method of claim 1, wherein the engine controller includes an engine control module (ECM) with an ECM driver submodule and an ECM monitor submodule, wherein the ECM driver submodule transmits the pulse signals to the fuel injectors, and wherein the ECM monitor submodule monitors the pulse signals and detects the cylinder misfires.

13. The method of claim 1, wherein the calibrated misfire limit is a predefined maximum allowable percentage value calibrated to the engine assembly, and the misfire ratio is calculated as a mathematical percentage of the total number of the cylinder misfires to the total number of the combustion cycles.

14. A non-transitory, computer-readable medium storing instructions executable by one or more processors of an engine controller of an engine assembly with multiple cylinders, multiple pistons reciprocally movable in the cylinders, and multiple fuel injectors operable to inject multiple pulses of fuel per combustion cycle to the cylinders, the instructions, when executed by the one or more processors, causing the engine controller to perform operations comprising:

determining if the fuel injectors are operating in a multi-pulse mode to actively inject multiple pulses of fuel per combustion cycle to the cylinders;

monitoring, responsive to determining the fuel injectors are operating in the multi-pulse mode, pulse signals transmitted to the fuel injectors to inject the multiple pulses of fuel per combustion cycle for multiple combustion cycles;

identifying, for each of the fuel injectors for each of the combustion cycles, a cylinder misfire if any one of the multiple pulses of the combustion cycle is missed;

determining, for each of the cylinders, a misfire ratio of a total number of the cylinder misfires to a total number of the combustion cycles; and transmitting, responsive to any one of the misfire ratios exceeding a calibrated misfire limit, a command signal to a resident subsystem to execute an automated control operation configured to mitigate the cylinder misfires.

15. A motor vehicle, comprising:

a vehicle body with a passenger compartment;

a plurality of road wheels attached to the vehicle body;

an engine assembly attached to the vehicle body and operable to drive one or more of the road wheels to thereby propel the motor vehicle, the engine assembly including multiple cylinders and multiple pistons each reciprocally movable in a respective one of the cylinders;

a fuel injection system including multiple fuel injectors each operable to inject multiple pulses of fuel per combustion cycle to a respective one of the cylinders; and an engine controller programmed to:

determine if the fuel injectors are operating in a multi-pulse mode to actively inject multiple pulses of fuel per combustion cycle to the cylinders;

responsive to determining the fuel injectors are operating in the multi-pulse mode, monitor pulse signals transmitted to the fuel injectors to inject the multiple pulses of fuel per combustion cycle for multiple combustion cycles;

identify, for each of the fuel injectors for each of the combustion cycles, a cylinder misfire if any one of the multiple pulses of the combustion cycle is missed;

determine, for each of the cylinders, a misfire ratio of a total number of the cylinder misfires to a total number of the combustion cycles; and responsive to any one of the misfire ratios exceeding a calibrated misfire limit, transmit a command signal to a resident subsystem to execute an automated control operation configured to mitigate the cylinder misfires.

16. The motor vehicle of claim 15, wherein monitoring the pulse signals transmitted to the fuel injectors includes tracking electrical signals generated by a driver submodule in the engine controller and output from the engine controller to the fuel injectors.

17. The motor vehicle of claim 15, wherein identifying the cylinder misfires includes detecting if any of the multiple pulses is missed by determining, for each of the tracked electrical signals, a substantially equivalent electrical signal is not received at nor output by a corresponding one of the fuel injectors.

18. The motor vehicle of claim 15, wherein the resident subsystem includes a port fuel injection (PFI) system of the fuel injection system of the motor vehicle, the fuel injectors include multiple PFI injectors, and the command signal causes the PFI system to disable the PFI injector for each of the cylinders in which the misfire ratio exceeds the calibrated misfire limit.

19. The motor vehicle of claim 15, wherein the resident subsystem includes an engine diagnostics module (EDM) and a vehicle display device inside the passenger compartment of the motor vehicle, and the command signal causes the EDM to set a diagnostic code and the vehicle display device to display a corresponding user notification indicating a need for engine service.

20. The motor vehicle of claim 15, wherein the fuel injectors include port fuel injection (PFI) injectors operable to indirectly inject fuel to the cylinders via intake ports of the engine assembly, the fuel injection system further includes direct injection (DI) injectors operable to inject fuel directly into the cylinders, and wherein the multi-pulse mode includes both the DI injectors and the PFI injectors jointly injecting fuel into the cylinders for the combustion cycles.

* * * * *